US011856669B1

(12) United States Patent
Cheng et al.

(10) Patent No.: US 11,856,669 B1
(45) Date of Patent: Dec. 26, 2023

(54) DRIVING METHOD FOR LED-BASED DISPLAY DEVICE

(71) Applicant: NOVATEK Microelectronics Corp., Hsinchu (TW)

(72) Inventors: Jhih-Siou Cheng, New Taipei (TW); Chih-Hsien Chou, Hsinchu (TW); Ren-Chieh Yang, Taichung (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 18/059,433

(22) Filed: Nov. 29, 2022

(51) Int. Cl.
*H05B 45/325* (2020.01)
*G09G 3/32* (2016.01)
*H05B 45/345* (2020.01)

(52) U.S. Cl.
CPC ..... *H05B 45/345* (2020.01); *H05B 45/325* (2020.01)

(58) Field of Classification Search
CPC .... H05B 45/32; H05B 45/325; H05B 45/345; G09G 3/30; G09G 3/32; G09G 3/3233; G09G 3/3266; G09G 3/3275; G09G 3/3291; G09G 2310/0278
See application file for complete search history.

(56) References Cited

U.S. PATENT DOCUMENTS

2010/0265277 A1* 10/2010 Takahara ..... G09G 3/3241 345/77
2015/0348463 A1 12/2015 Lee
2018/0005576 A1 1/2018 Yoon et al.
2022/0366847 A1 11/2022 An et al.

* cited by examiner

*Primary Examiner* — Jimmy T Vu
(74) *Attorney, Agent, or Firm* — CKC & Partners Co., LLC

(57) ABSTRACT

A driving method, for a controller in a display apparatus, is disclosed. The display apparatus includes LED strings, scan transistors, current regulators and a power converter. The driving method includes following steps. LED cathode voltages are detected on nodes between the LED strings and the current regulators. When a first LED cathode voltage is equal to a minimal operable voltage of the current regulators and a second LED cathode voltage exceeds the minimal operable voltage of the current regulators, a driving current flowing through the second data channel is adjusted by increasing a pulse current level of the driving current and reducing a duty cycle ratio of the driving current flowing through the second data channel.

10 Claims, 17 Drawing Sheets

DRIVING METHOD FOR LED-BASED DISPLAY DEVICE

BACKGROUND

Field of Invention

The disclosure relates to a driving method. More particularly, the disclosure relates to a driving method for driving LED strings in a display apparatus.

Description of Related Art

On a modern display device, light-emitting diodes (LED) are widely used as light sources or colored light generators. In order to achieve a higher resolution on a LED-based display device, there are more and more LED strings to be accommodated in one display device. Generally, to drive more LED strings in the display device, more LED driving circuits are required. However, including more LED driving circuits in the display device will induce extra costs and higher power consumption of the display device.

A display device including a LED driver with XY scanning structure is able to drive more LED strings. For example, a LED driver with 6 scanning channels and 32 data channels are able to drive total 192 LED strings. In some cases, scan transistors, current regulators and LED strings in the LED driver with the XY scanning structure will induce heats while operating. It is important to reduce the heats induced by the LED driver and also balance a heat distribution between the scan transistors and the current regulators within the LED driver.

SUMMARY

An embodiment of the disclosure provides a driving method, which is suitable for a controller in a display apparatus. The display apparatus includes LED strings, scan transistors, current regulators and a power converter. The LED strings are arranged in X scanning channels and Y data channels. The scan transistors correspond to the X scanning channels. The current regulators correspond to the Y data channels. The power converter is configured to provide a common driving voltage to the X scanning channels. X and Y are positive integers larger than one. The driving method includes following steps. LED cathode voltages are detected on nodes between the LED strings and the current regulators corresponding to the Y data channels. The LED cathode voltages include a first LED cathode voltage corresponding to a first data channel and a second LED cathode voltage corresponding to a second data channel. In response to that the first LED cathode voltage is equal to a minimal operable voltage of the current regulators and the second LED cathode voltage exceeds the minimal operable voltage of the current regulators, a driving current flowing through the second data channel is adjusted by increasing a pulse current level of the driving current and to reducing a duty cycle ratio of the driving current flowing through the second data channel.

An embodiment of the disclosure provides a driving method, which is suitable for a controller in a display apparatus. The display apparatus includes LED strings, scan transistors, current regulators and a power converter. The LED strings are arranged in X scanning channels and Y data channels. The scan transistors correspond to the X scanning channels. The current regulators correspond to the Y data channels. The power converter is configured to provide a common driving voltage to the X scanning channels. X and Y are positive integers larger than one. The driving method includes following steps. LED cathode voltages are detected on nodes between the LED strings and the current regulators corresponding to the Y data channels. The LED cathode voltages include a first LED cathode voltage corresponding to a first data channel and a second LED cathode voltage corresponding to a second data channel. In response to that the first LED cathode voltage is equal to a minimal operable voltage of the current regulators and the second LED cathode voltage exceeds the minimal operable voltage of the current regulators, a voltage drop over one corresponding scan transistor on the second scanning channel is adjusted.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
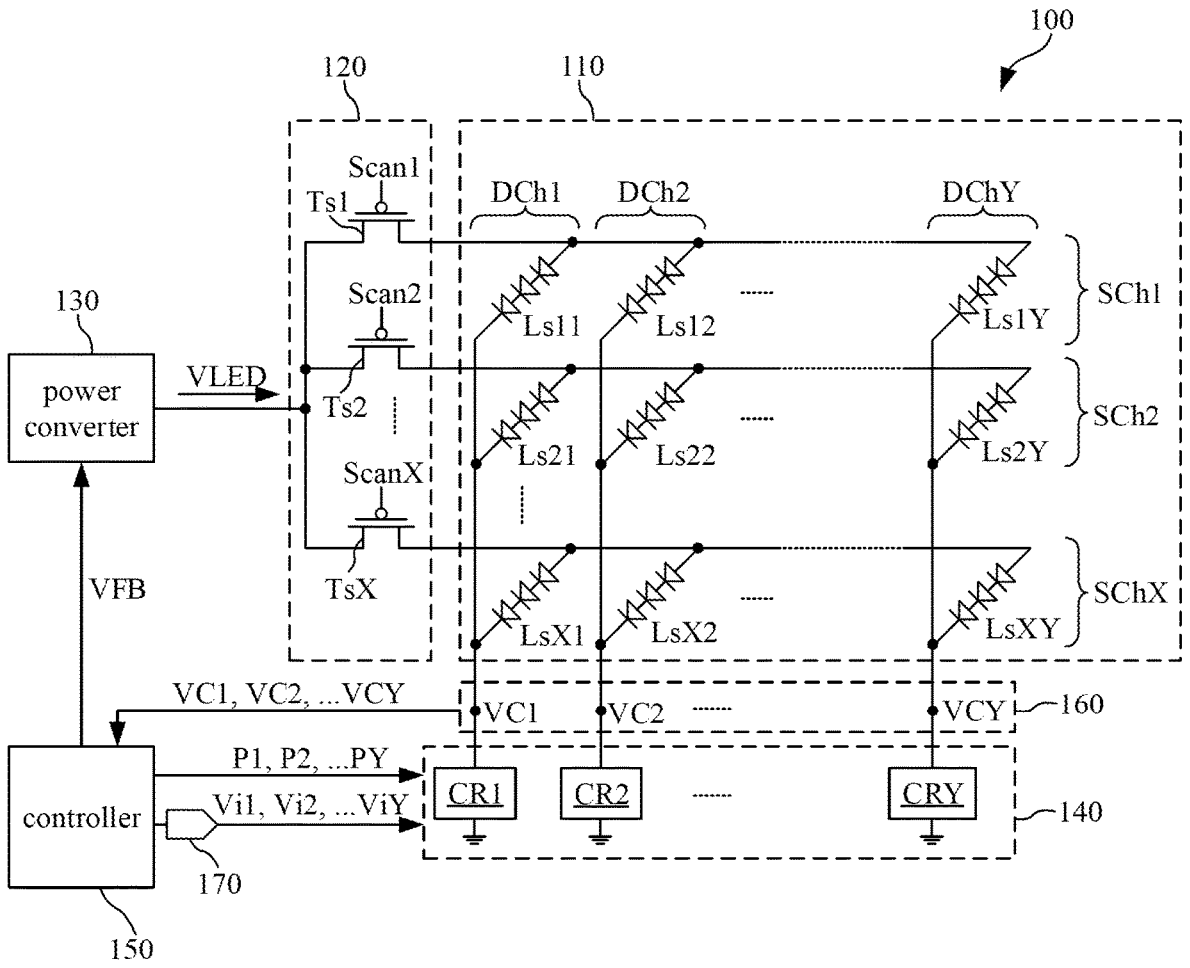
FIG. 1 is a schematic diagram illustrating a display apparatus according to some embodiments of this disclosure.

Reference will now be made in detail to the present embodiments of the disclosure, examples of which are illustrated in the accompanying drawings. Wherever possible, the same reference numbers are used in the drawings and the description to refer to the same or like parts.

Reference is made to FIG. 1, which is a schematic diagram illustrating a display apparatus 100 according to some embodiments of this disclosure. As shown in FIG. 1, the display apparatus 100 includes LED strings 110, a scan module 120, a power converter 130, a current regulation module 140, a controller 150 and a peripheral circuit 160.

In some embodiments, as shown in FIG. 1, the LED strings 110 include X*Y LED strings Ls11~LsXY, which are arranged in X scanning channels and Y data channels. X and Y are positive integers larger than one. For example, X can be 6 and Y can be 32. However, the disclosure is not limited to this specific channel numbers.

As shown in FIG. 1, the LED strings Ls11, Ls12 . . . Ls1Y along a horizontal direction are arranged on a scanning channel SCh1; the LED strings Ls21, Ls22 . . . Ls2Y along a horizontal direction are arranged on another scanning channel SCh2; and, the LED strings LsX1, LsX2 LsXY along a horizontal direction are arranged on another scanning channel SChX.

As shown in FIG. 1, the LED strings Ls11, Ls21 . . . LsX1 along a vertical direction are arranged on a data channel DCh1; the LED strings Ls12, Ls22 . . . LsX2 along a vertical direction are arranged on another data channel DCh2; and, the LED strings Ls1Y, Ls2Y LsXY along a vertical direction are arranged on another data channel DChY.

It is noticed that, as shown in FIG. 1, each of the LED strings Ls11~LsXY are illustrated to include three LEDs for demonstration. However, an amount of LEDs in each of the LED strings Ls11~LsXY are not limited to a specific number.

As shown in FIG. 1, the power converter 130 is configured to provide a common driving voltage VLED to the X scanning channels SCh1-SChX. During a light-emitting period, the common driving voltage VLED is utilized to drive anodes of the LED strings Ls11~LsXY, such that the LED strings Ls11~LsXY powered by the common driving voltage VLED can illuminate accordingly.

As shown in FIG. 1, the scan module 120 includes a scan transistor Ts1 corresponding to the scanning channel SCh1, another scan transistor Ts2 corresponding to the scanning channel SCh2 . . . and another scan transistor TsX corresponding to the scanning channel SChX. Each of the scan transistor Ts1~TsX corresponds one of the scanning channels SCh1-SChX. When the scan transistor Ts1 is conducted by a scan voltage signal Scan1, the common driving voltage VLED will pass through the scan transistor Ts1 to the scanning channel SCh1. Similarly, when the scan transistor Ts2 is conducted by a scan voltage signal Scan2, the common driving voltage VLED will pass through the scan transistor Ts2 to the scanning channel SCh2. Similarly, when the scan transistor TsX is conducted by a scan voltage signal ScanX, the common driving voltage VLED will pass through the scan transistor TsX to the scanning channel SChX.

As shown in FIG. 1, the current regulation module 140 includes a current regulator CR1 corresponding to the data channel DCh1, another current regulator CR2 corresponding to the data channel DCh2 . . . and another current regulator CRY corresponding to the data channel DChY. Each of the current regulators CR1~CRY corresponds one of the data channels DCh1~DChY. The current regulator CR1 is configured to control a driving current flowing through the data channel DCh1 (and the LED strings Ls11~LsX1 on the data channel DCh1). Similarly, the current regulator CR2 is configured to control a driving current flowing through the data channel DCh2 (and the LED strings Ls12~LsX2 on the data channel DCh2). Similarly, the current regulator CRY is configured to control a driving current flowing through the data channel DChY (and the LED strings Ls1Y-LsXY on the data channel DChY).

Figure 2:
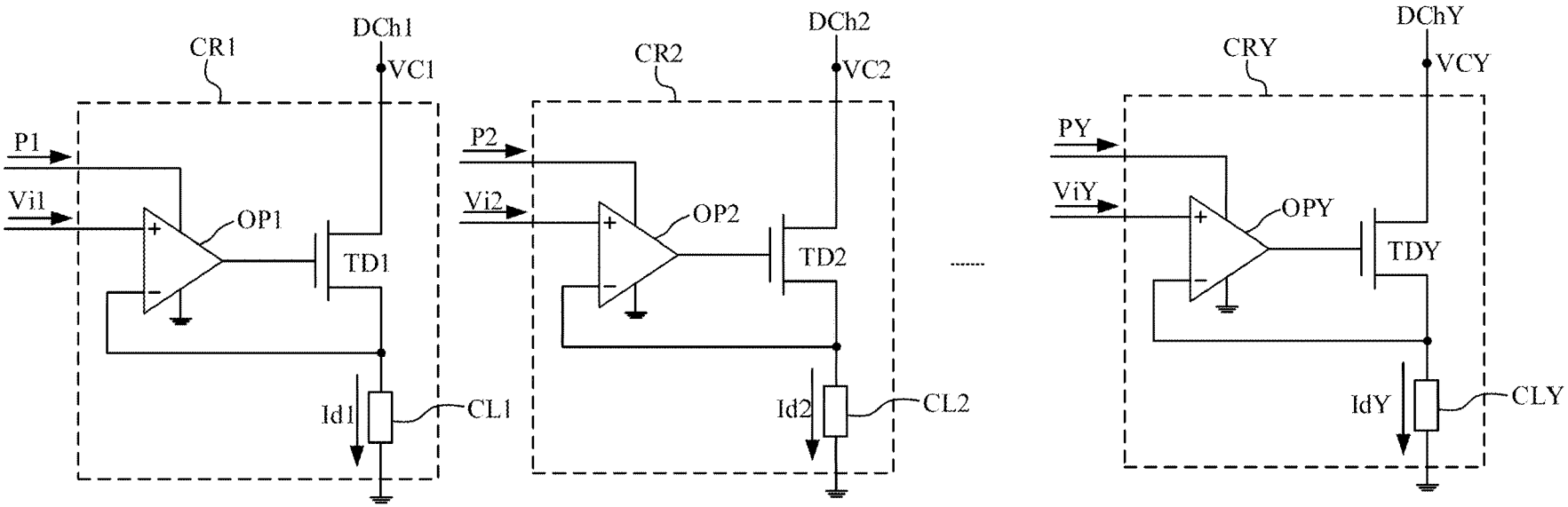
FIG. 2 is a schematic diagram illustrating an internal structure of the current regulators in FIG. 1 according to some embodiments.

Reference is further made to FIG. 2, which is a schematic diagram illustrating an internal structure of the current regulators CR1-CRY in FIG. 1 according to some embodiments. As shown in FIG. 2, each of the current regulators CR1~CRY includes a driving transistor, an operational amplifier and a current load.

For example, the current regulator CR1 includes a driving transistor TD1, an operational amplifier OP1 and a current load CL1. A source/drain terminal of the driving transistor TD1 is coupled to the data channel DCh1 (and cathodes of the LED strings on the data channel DCh1 referring to FIG. 1). Another source/drain terminal of the driving transistor TD1 is coupled to the current load CL1. A gate terminal of the driving transistor TD1 is coupled to an output of the operational amplifier OP1. The operational amplifier OP1 is configured to control the gate terminal of the driving transistor TD1 according to a pulse width control signal P1 and a level control signal Vi1 provided by the controller 150 (referring to FIG. 1). In some embodiments, the current load CL1 can be implemented by a passive electric load (e.g., a resistor). The current regulator CR1 is configured to regulate a driving current Id1 flowing through the data channel DCh1 according to the pulse width control signal P1 and the level control signal Vi1. For example, when the level control signal Vi1 has a higher voltage level, the driving current Id1 has a higher current amplitude; when the level control signal Vi1 has a lower voltage level, the driving current Id1 has a lower current amplitude. When the pulse width control signal P1 has a higher duty cycle ratio, the driving current Id1 has a longer pulse width; when the pulse width control signal P1 has a lower duty cycle ratio, the driving current Id1 has a shorter pulse width.

Similarly, the current regulator CR2 includes a driving transistor TD2, an operational amplifier OP2 and a current load CL2. The current regulator CR2 is configured to regulate a driving current Id2 flowing through the data channel DCh2 according to the pulse width control signal P2 and the level control signal Vi2. The current regulator CRY includes a driving transistor TDY, an operational amplifier OPY and a current load CLY. The current regulator CRY is configured to regulate a driving current IdY flowing through the data channel DChY according to the pulse width control signal PY and the level control signal ViY.

As shown in FIG. 1, the controller 150 is configured to provide the pulse width control signals P1~PY and the level control signals Vi1~ViY, so as to control the current regulators CR1~CRY. In some embodiments, the display apparatus 100 further includes a digital to analog converter (DAC) 170, which is configured to convert the level control signals Vi1~ViY from a digital format into an analog format.

In order to make sure that the current regulators CR1~CRY operate properly (i.e., regulating the driving currents properly), a minimal operable voltage (Vmin, not shown in FIG. 2) is required by each of the current regulators CR1-CRY. For example, when a LED cathode voltage VC1 on data channel DCh1 is lower than the minimal operable voltage, the current regulator CR1 is not able to operate properly. Similarly, when a LED cathode voltage VC2 on data channel DCh2 is lower than the minimal operable voltage, the current regulator CR2 is not able to operate properly. In some embodiments, the minimal operable voltage of the current regulators CR1~CRY are determined according to a threshold voltage of the driving transistors TD1~TDY and/or the current loads CL1~CLY. In a demonstrational example, the current regulators CR1~CRY may have a minimal operable voltage at 0.5V.

As shown in FIG. 1, the peripheral circuit 160 is coupled between the LED strings 110 and the current regulation module 140. The peripheral circuit 160 is configured to detect LED cathode voltages VC1~VCY on nodes between the LED strings 110 and the current regulation module 140, and transmit the LED cathode voltages VC1~VCY to the controller 150.

As mentioned above, when any one of the LED cathode voltages VC1~VCY is lower than the minimal operable voltage, the corresponding current regulator may malfunction. On the other hand, when all of the LED cathode voltages VC1~VCY are far higher than the minimal operable voltage, the current regulation module 140 will consume unnecessary power and induce extra heats. In some embodiments, the display apparatus 100 execute a driving method to monitor the LED cathode voltages VC1~VCY and drive the LED strings 110 accordingly to avoid unnecessary power consumption, extra heats and/or the malfunction of the current regulators CR1~CRY.

Figure 3:
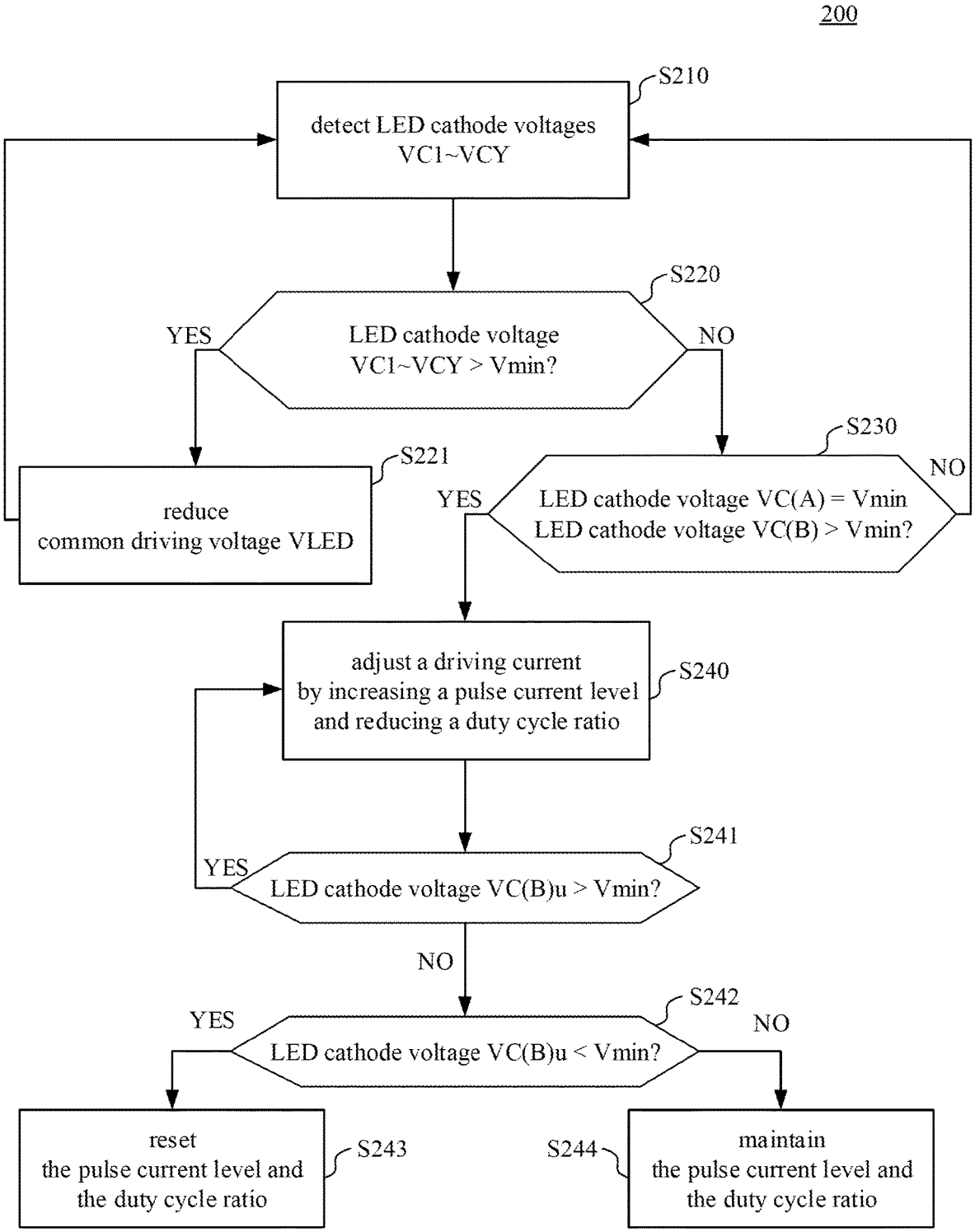
FIG. 3 is a flow chart illustrating a driving method according to some embodiments of the disclosure.

Reference is made to FIG. 3, which is a flow chart illustrating a driving method 200 according to some embodiments of the disclosure. In some embodiments, the driving method 200 in FIG. 3 can be executed by the controller 150 of the display apparatus 100 as shown in FIG. 1.

As shown in FIG. 1 and FIG. 3, step S210 is executed by the controller 150, to detect the LED cathode voltages VC1~VCY on nodes between the LED strings 110 and the current regulation module 140 corresponding to these Y data channels DCh1~DChY. In some embodiments, the controller 150 collects the LED cathode voltages VC1~VCY through the peripheral circuit 160.

As shown in FIG. 1 and FIG. 3, step S220 is executed by the controller 150, to determine whether all of the LED cathode voltages VC1~VCY exceed the minimal operable voltage Vmin of the current regulators CR1~CRY or not.

Figure 4A:
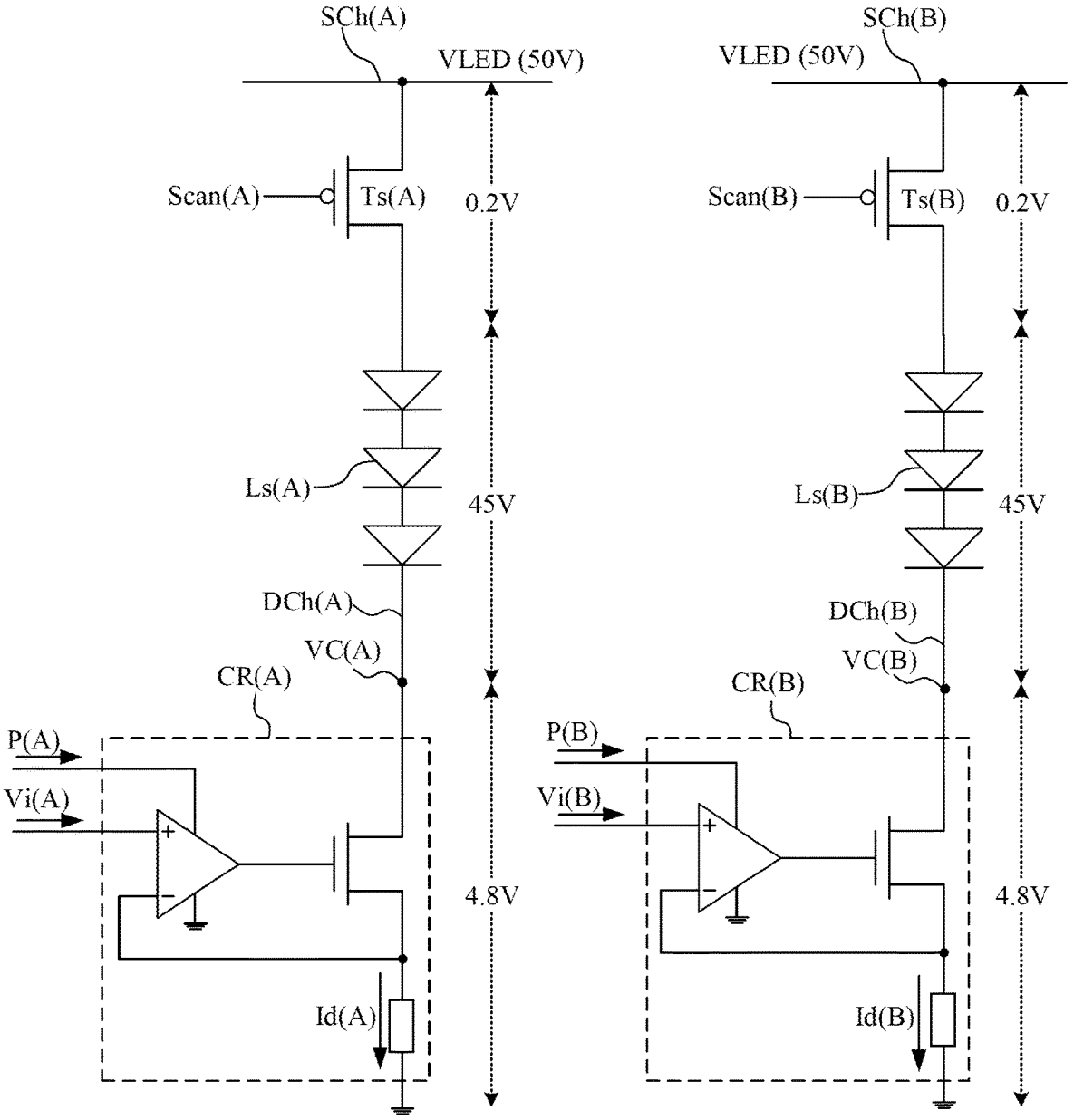
FIG. 4A is a schematic diagram illustrating circuit structures relative to a LED cathode voltage on a data channel and another LED cathode voltages on another data channel according to some embodiments of the disclosure.

Reference is further made to FIG. 4A, which is a schematic diagram illustrating circuit structures relative to a LED cathode voltage VC(A) on a data channel DCh1 and another LED cathode voltages VC(B) on a data channel DCh(B) according to some embodiments of the disclosure. The LED cathode voltages VC(A) and VC(B) in FIG. 4A are utilized to represent any two LED cathode voltages selected from the LED cathode voltages VC1~VCY. The data channels DCh(A) and DCh(B) in FIG. 4A are utilized to represent any two LED cathode voltages selected from the LED cathode voltages VC1~VCY.

FIG. 4A shows a demonstrational condition that all of the LED cathode voltages VC(A) and VC(B) exceed the minimal operable voltage Vmin. As shown in FIG. 4A, the LED cathode voltages VC(A) and VC(B) are higher than the minimal operable voltage Vmin. In this case, the LED cathode voltages VC(A) and VC(B) are both at 4.8V, which is higher than the minimal operable voltage Vmin (e.g., 0.5V). The current regulators CR(A) and CR(B) operating at 4.8V will consume unnecessary power and induce extra heats.

Figure 4B:
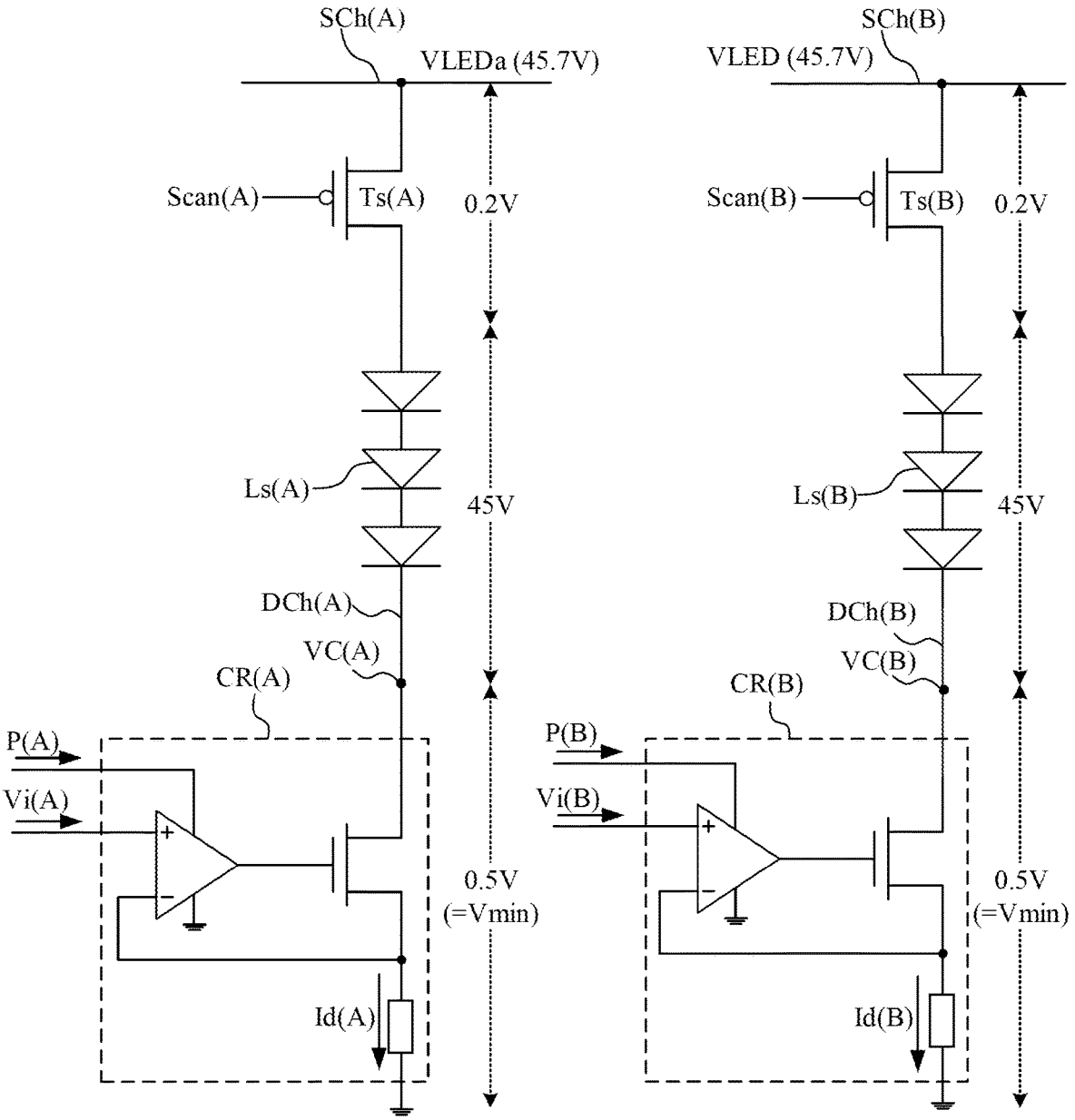
FIG. 4B is a schematic diagram illustrating circuit structures relative to the data channels in FIG. 4A after reducing the common driving voltage.

In response to that all of the LED cathode voltages VC1~VCY exceed the minimal operable voltage Vmin, step S221 is executed by the controller 150, the controller 150 provides a voltage feedback signal VFB to the power converter 130 to reduce a voltage level of the common driving voltage VLED. Reference is further made to FIG. 4B, which is a schematic diagram illustrating circuit structures relative to the data channels DCh(A) and DCh(B) in FIG. 4A after reducing the common driving voltage. As shown in FIG. 4B, the common driving voltage VLEDa is reduced from 50V to 45.7V, such that the LED cathode voltages VC(A) and VC(B) are correspondingly reduced to 0.5V, which is equal to the minimal operable voltage Vmin. In this case, the power consumption and the heat dissipation of the current regulators CR(A) and CR(B) can be reduced.

In some embodiments, step S221 is executed to reduce the voltage level of the common driving voltage until at least one of the LED cathode voltages VC1~VCY reaches the minimal operable voltage Vmin. If all of the LED cathode voltages VC1~VCY still exceed the minimal operable voltage Vmin, the steps S220 and S221 can be executed repeatedly.

If at least one of the LED cathode voltages VC1~VCY does not exceed the minimal operable voltage Vmin, step S230 is executed by the controller 150, to detect a condition that one LED cathode voltage VC(A) reaches the minimal operable voltage Vmin while another LED cathode voltage VC(B) still exceeding the minimal operable voltage Vmin.

Figure 5A:
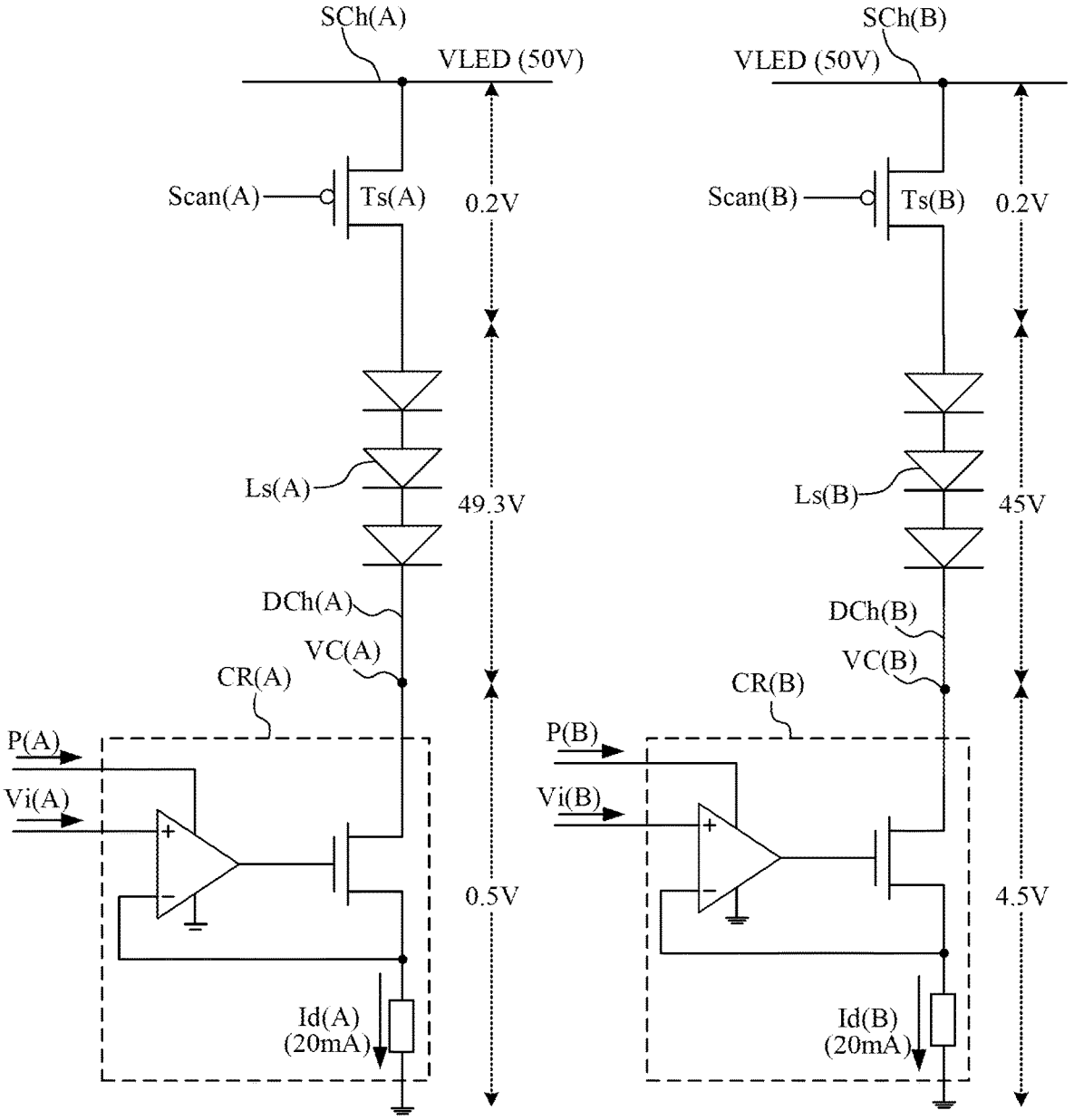
FIG. 5A is a schematic diagram illustrating a demonstrational condition that one LED cathode voltage reaches the minimal operable voltage while another LED cathode voltage still exceeding the minimal operable voltage.

FIG. 5A is a schematic diagram illustrating a demonstrational condition that one LED cathode voltage VC(A) reaches the minimal operable voltage Vmin while another LED cathode voltage VC(B) still exceeding the minimal operable voltage Vmin. Ideally, the LED strings are manufactured to have same electronic parameters (e.g., the same resistance, the same impendence, operating with the same cross voltage). In some practical applications, due to manufacturing variations, different LED strings may have different electronic parameters. As shown in the demonstrational condition in FIG. 5A, under at the same level of the common driving voltage VLED, a voltage difference over the LED string Ls[A] at 49.3V is different from another voltage difference over the LED string Ls[B] at 45V, because of the manufacturing variations between the LED strings Ls[A] and Ls[B]. Accordingly, the LED cathode voltage VC(A) and the LED cathode voltage VC(B) will be different. As shown in FIG. 5A, the LED cathode voltage VC(A) is equal to the minimal operable voltage Vmin, and the LED cathode voltage VC(B) still exceeds the minimal operable voltage Vmin. In this case, if the controller 150 further reduces the common driving voltage VLED, the current regulator CR(A) will not able to operate properly. In current embodiments, the driving method 200 do not adjust the common driving voltage VLED under this demonstrational condition.

Figure 5B:
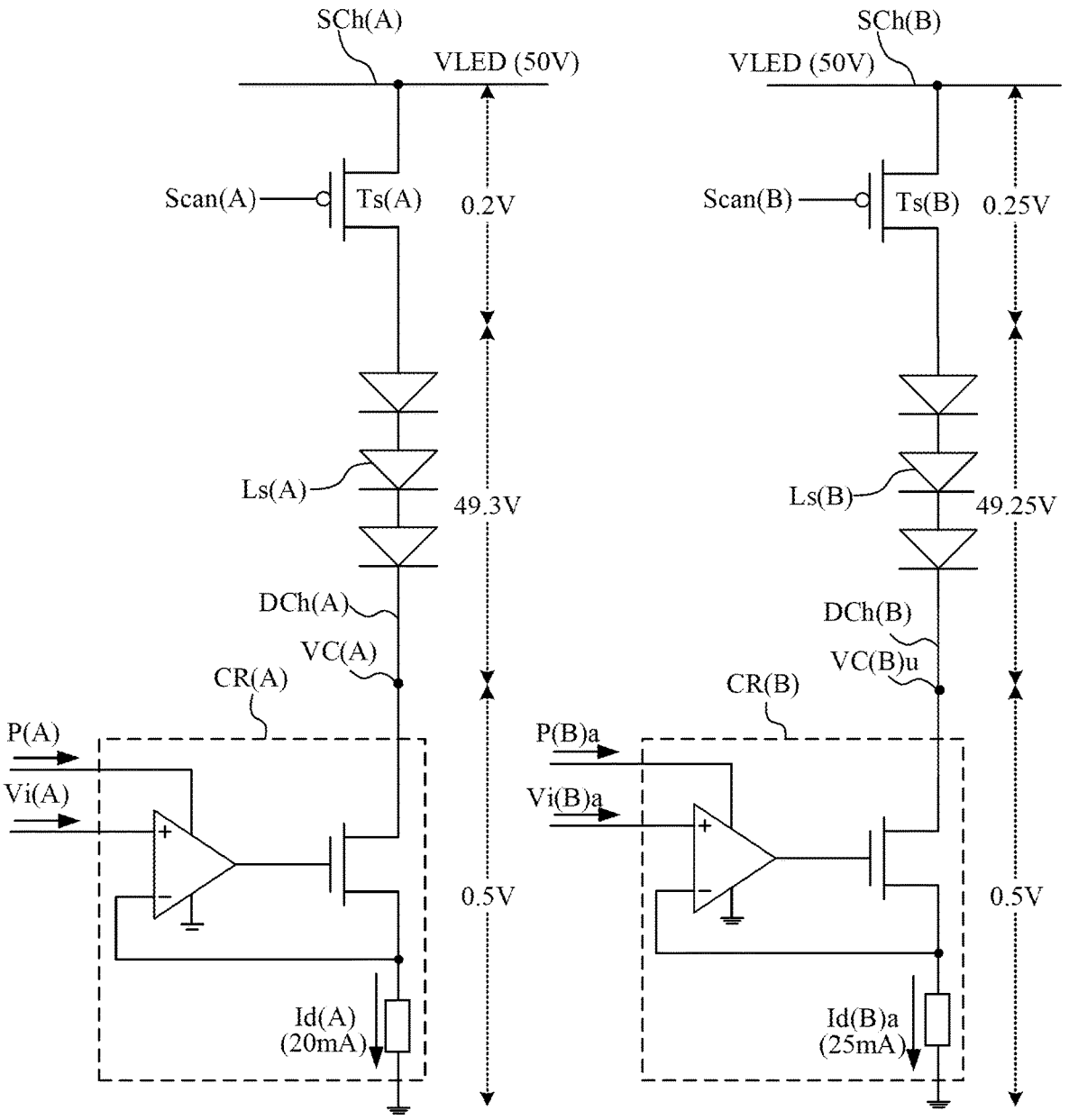
FIG. 5B is a schematic diagram illustrating circuit structures relative to the data channels in FIG. 5A after adjusting the driving current.
Figure 6:
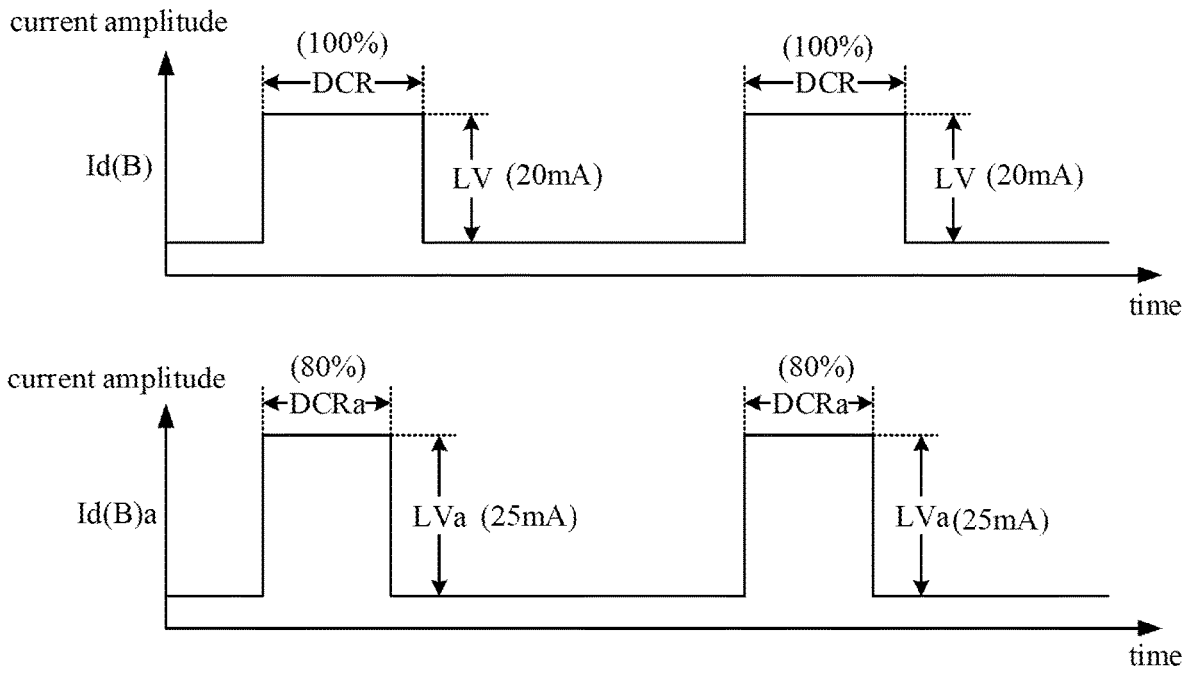
FIG. 6 is a signal waveform diagram illustrating a driving current before adjusting and a driving current after adjusting.

In response to the demonstrational condition (i.e., VC(A)=Vmin and VC(B)>Vmin) in FIG. 5A is detected by the controller 150, step S240 is executed by the controller 150 to adjust a driving current Id(B) on the data channel DCh(B). Reference is further made to FIG. 5B and FIG. 6. FIG. 5B is a schematic diagram illustrating circuit structures relative to the data channels DCh(A) and DCh(B) in FIG. 5A after adjusting the driving current. FIG. 6 is a signal waveform diagram illustrating a driving current Id(B) before adjusting and another driving current Id(B)a after adjusting.

In step S240, as shown in FIG. 5B, the controller 150 provide a pulse width control signal P(B)a and a level control signal Vi(B)a to one corresponding current regulator CR(B) on the data channel DCh(B) for adjusting the driving current Id(B)a. In the demonstrational example as shown in FIG. 6, the driving current Id(B) before adjusting has a duty cycle ratio DCR at 100% and a pulse current level of the driving current Id(B) at 20 mA.

In the demonstrational example as shown in FIG. 5B and FIG. 6, the driving current Id(B)a after adjusting has a lower duty cycle ratio DCR at 80% and a higher pulse current level of the driving current Id(B)a at 25 mA. In other words, the controller 150 adjusts the driving current flowing through the data channel DCh(B) by increasing the pulse current level (from LV into LVa) of the driving current Id(B)a and to reducing a duty cycle ratio (from DCR into DCRa) of the driving current Id(B)a.

As shown in FIG. 5B, because the pulse current level of the driving current Id(B)a is currently increased to 25 mA, a voltage difference over the scan transistor Ts(B) and a voltage difference over the LED string Ls(B) will increase correspondingly, compared to FIG. 5A. In this case, a voltage level of the LED cathode voltage VC(B)u in FIG. 5B will reduce accordingly.

After adjusting the driving current (S240), the driving method 200 executes step S241 to detect the updated LED cathode voltage VC(B)u corresponding to the data channel DCh(B). If the updated LED cathode voltage VC(B)u still exceeds the minimal operable voltage Vmin, the driving method 200 returns to step S240 for keeping increasing the pulse current level LVa of the driving current Id(B)a and reducing the duty cycle ratio DCRa of the driving current Id(B)a. In some embodiments, step S240 is repeated until that the updated LED cathode voltage VC(B)u is reduced to the minimal operable voltage Vmin.

In addition, the driving method 200 further include step S242 is determine whether the updated LED cathode voltage VC(B)u is over-reduced as being lower than the minimal operable voltage Vmin. If the updated LED cathode voltage VC(B)u is lower than the minimal operable voltage Vmin, step S243 is executed by the controller 150 for resetting the pulse current level LVa of the driving current Id(B)a to a previous current level and resetting the duty cycle ratio DCRa of the driving current Id(B)a to a previous duty cycle ratio, so as to avoid the over-reduction of the updated LED cathode voltage VC(B)u. If the updated LED cathode voltage VC(B)u is equal to the minimal operable voltage Vmin, step S244 is executed by the controller 150 for maintaining the pulse current level LVa of the driving current Id(B)a and maintaining the duty cycle ratio DCRa of the driving current Id(B)a.

As shown in FIG. 5B, after adjusting the driving current Id(B)a, the updated LED cathode voltage VC(B)u on the data channel DCh(B) can be reduced to the minimal operable voltage Vmin, which is similar to the LED cathode voltage VC(A) on the data channel DCh(A). In this case, the current regulator CR(A) and the current regulator CR(B) can be driven under the same voltage difference. In this case, the heat generated by the current regulator CR(A) can be relatively closer to the heat generated by the current regulator CR(B) in the embodiment shown FIG. 5B after adjusting the driving current Id(B)a, compared to FIG. 5A. In other words, by adjusting the driving current Id(B)a, the driving method 200 is able to improve a heat distribution balance between different current regulators CR1~CRY as shown in FIG. 1. In this case, the heat will not likely to gather at one particular current regulator.

As shown in FIG. 6, the driving current Id(B) has a 100% duty cycle ratio at 20 mA. The average current level of the driving current Id(B) is 20 mA (i.e., 100%*20 mA). The driving current Id(B)a has a 80% duty cycle ratio at 25 mA. The average current level of the driving current Id(B)a is 20 mA (80%*25 mA). Therefore, an average current level of the driving current during one duty cycle time is constant between the driving current Id(B) before adjusting and the driving current Id(B)a after adjusting.

Figure 7:
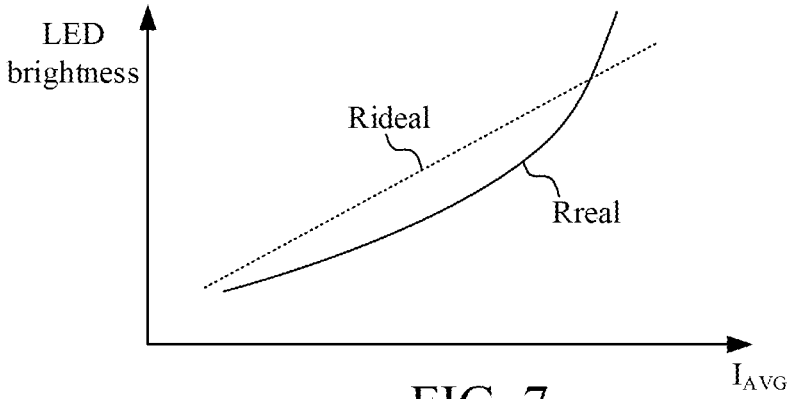
FIG. 7 is a relationship diagram between an average current level of the driving current on a LED string and LED brightness generated by the LED string.
Figure 8:
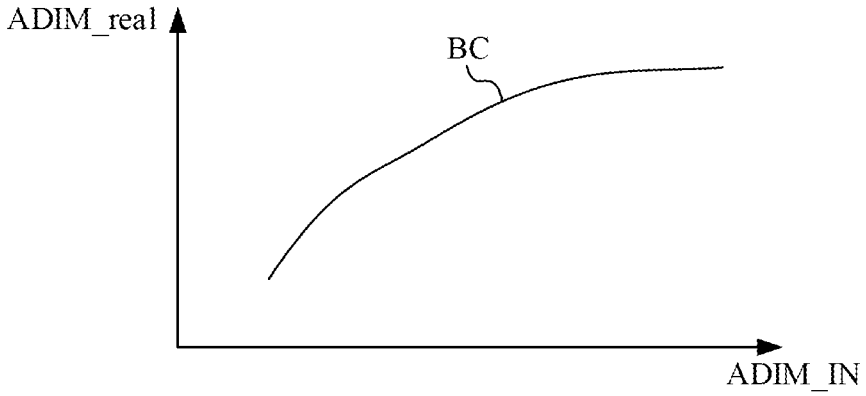
FIG. 8 is a relationship diagram illustrating a brightness calibration curve to calibrate a non-linearity between the brightness generated by the LED strings and the average current level of the driving current during one duty cycle time.

Reference is further made to FIG. 7 and FIG. 8. FIG. 7 is a relationship diagram between an average current level IAVG of the driving current on a LED string and LED brightness generated by the LED string. According to an ideal curve Rideal, the average current level IAVG of the driving current and the LED brightness has a linear relationship. However, in a practical application, a real curve Rreal between the average current level IAVG and LED brightness is not a linear relationship. FIG. 8 is a relationship diagram illustrating a brightness calibration curve BC to calibrate a non-linearity between the brightness generated by the LED strings and the average current level IAVG of the driving current during one duty cycle time. An input brightness code ADIM_IN can be calibrated according to the brightness calibration curve BC shown in FIG. 8 into an output brightness code ADIM_real. In some embodiments, the brightness calibration curve BC can be represented by and stored as a mapping table.

Figure 9:
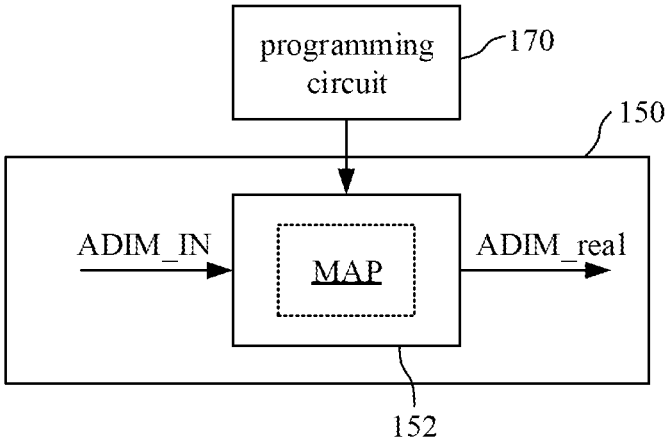
FIG. 9 is a schematic diagram illustrating a mapping table in the controller according to some embodiments.

Reference is further made to FIG. 9, which is a schematic diagram illustrating the mapping table MAP in the controller 150 according to some embodiments. The mapping table MAP in FIG. 9 stores the relationship of the brightness calibration curve BC shown in FIG. 8. In some embodiments, the controller 150 can utilize the mapping table MAP to calibrate the level control signal, so as to compensate a non-linearity between the brightness generated by the LED strings and the average current level IAVG of the driving current during one duty cycle time.

As shown in FIG. 9, the mapping table MAP is written into a non-volatile memory 152 in the controller 150. In some embodiments, the non-volatile memory 152 can include an electric fuse (eFuse) or a one-time-programmable (OTP) memory.

Figure 10:
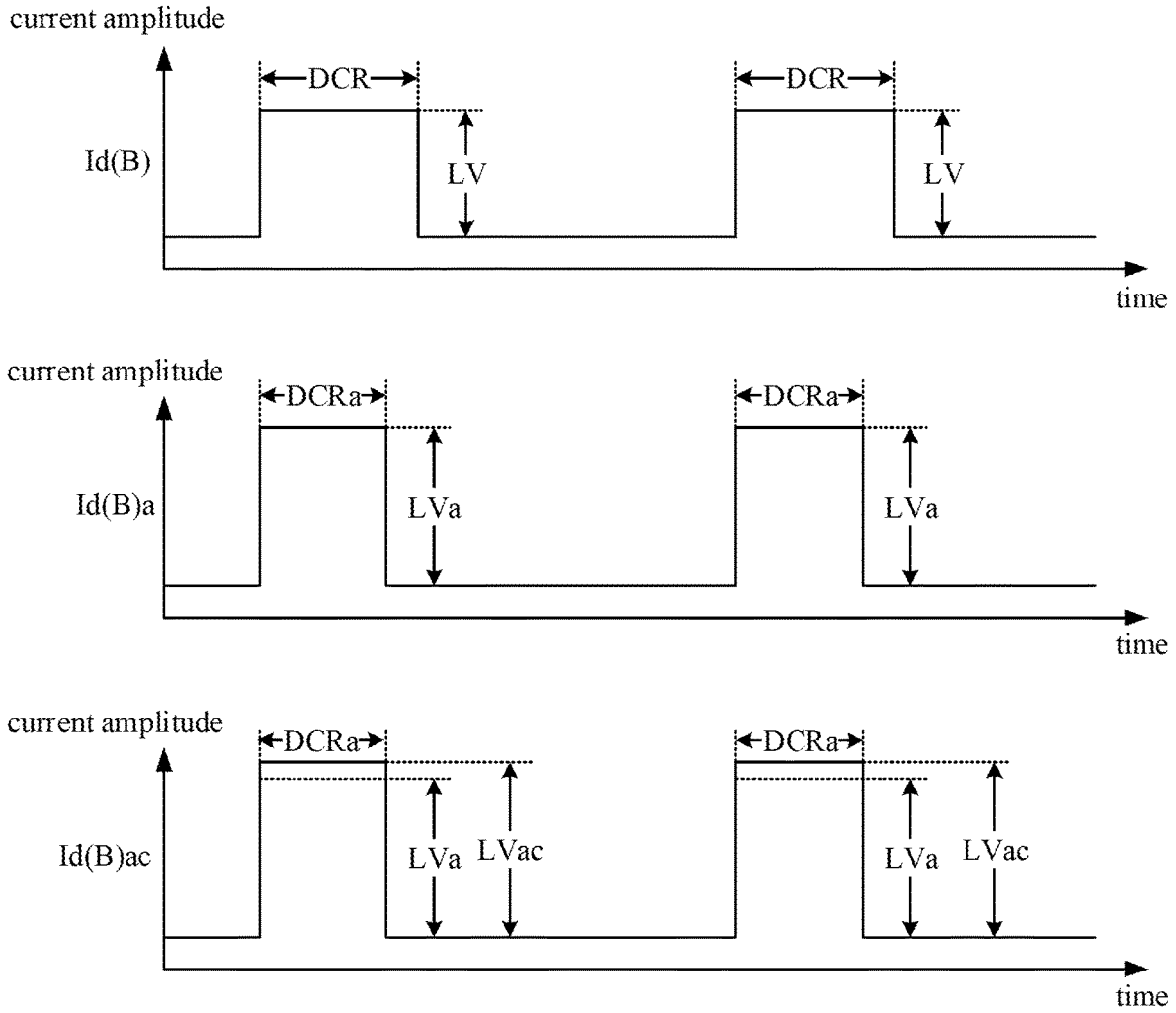
FIG. 10 is a signal waveform diagram illustrating a driving current before adjusting, another driving current after adjusting and also a calibrated driving current after calibrating the non-linearity between the brightness generated by the LED strings and the average current level of the driving current.

FIG. 10 is a signal waveform diagram illustrating a driving current Id(B) before adjusting, another driving current Id(B)a after adjusting and also a calibrated driving current Id(B)ac after calibrating the non-linearity between the brightness generated by the LED strings and the average current level IAVG of the driving current. As shown in FIG. 10, after calibrating the non-linearity, the calibrated driving current Id(B)ac may have another pulse current level LVac different from the pulse current level LVa of the driving current Id(B)a. As shown in FIG. 10, the calibrated driving current Id(B)ac and the driving current Id(B)a share the same duty cycle ratio DCRa.

In aforesaid embodiments in FIG. 3, when VC(A)=Vmin and VC(B)>Vmin, step S240 in the driving method 200 is executed to adjust the driving current Id(B) flowing through the data channel DCh(B), so as to reduce the LED cathode voltage VC(B) corresponding to the data channel DCh(B). However, this disclosure is not limited to adjust the driving current Id(B).

Figure 11:
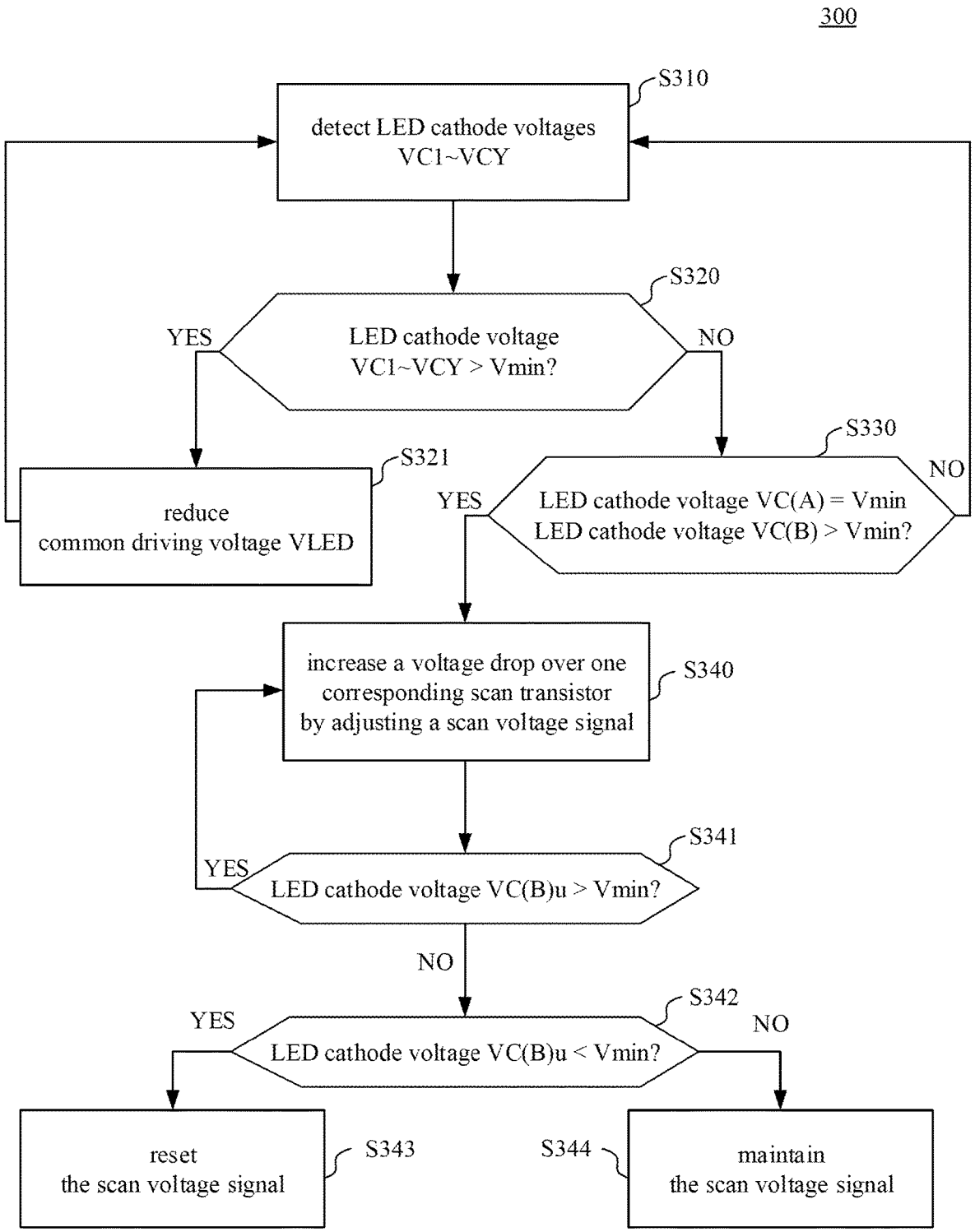
FIG. 11 is a flow chart illustrating a driving method according to some embodiments of the disclosure.

Reference is made to FIG. 11, which is a flow chart illustrating a driving method 300 according to some embodiments of the disclosure. In some embodiments, the driving method 300 in FIG. 11 can be executed by the controller 150 of the display apparatus 100 as shown in FIG. 1.

It is noticed that, steps S340, S343 and S344 in the driving method 300 in FIG. 11 are different from steps S240, S243 and S244 the driving method 200 in FIG. 3. Other steps S310, S320, S321, S330, S341 and S342 in the driving method 300 in FIG. 11 are similar to steps S210, S220, S221, S230, S241 and S242 in the driving method 200 in FIG. 3 discussed in aforesaid embodiments. Therefore, details of the similar steps are not repeated here again.

Figure 12A:
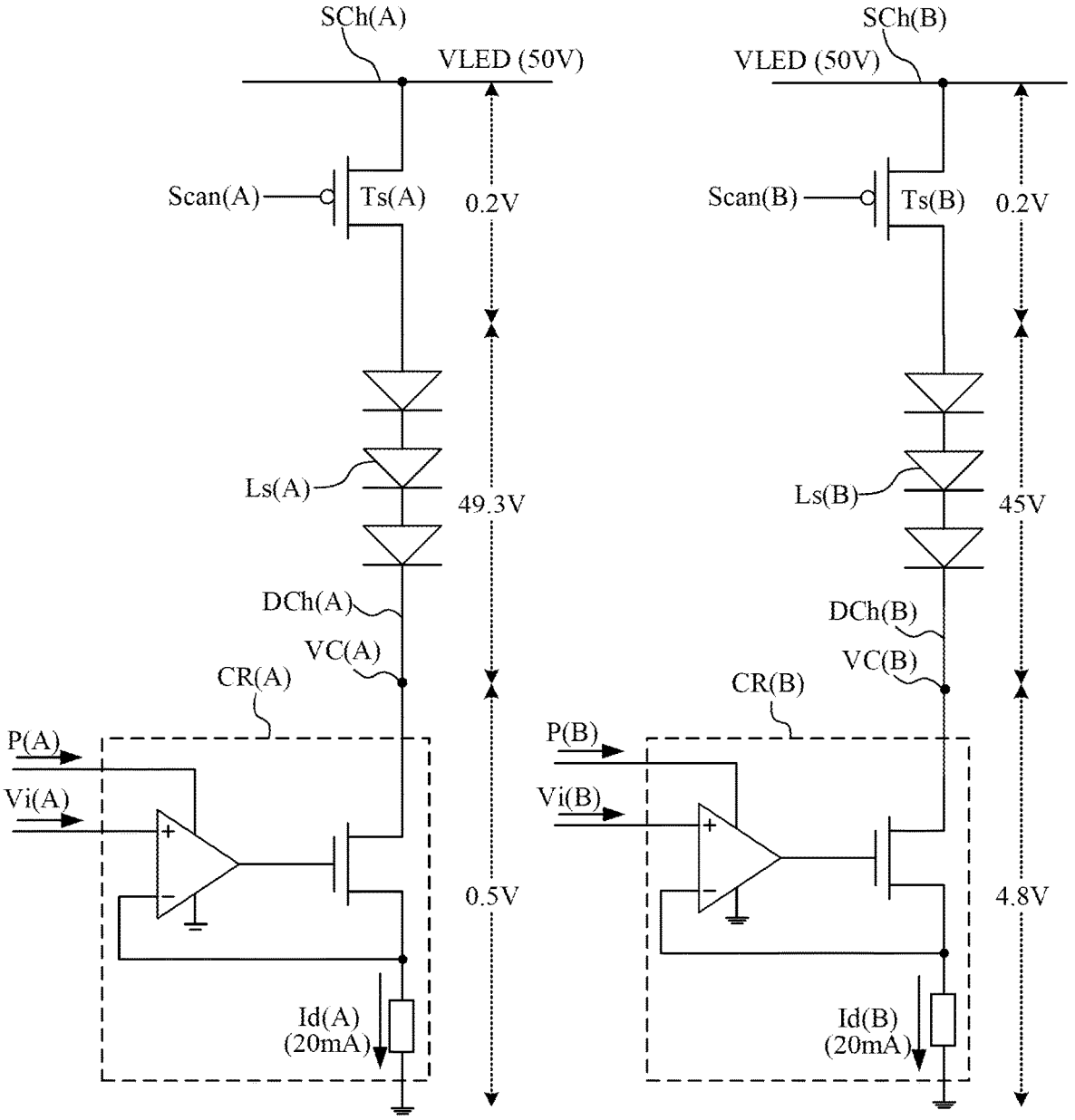
FIG. 12A is a schematic diagram illustrating a demonstrational condition that one LED cathode voltage reaches the minimal operable voltage while another LED cathode voltage still exceeding the minimal operable voltage.
Figure 12B:
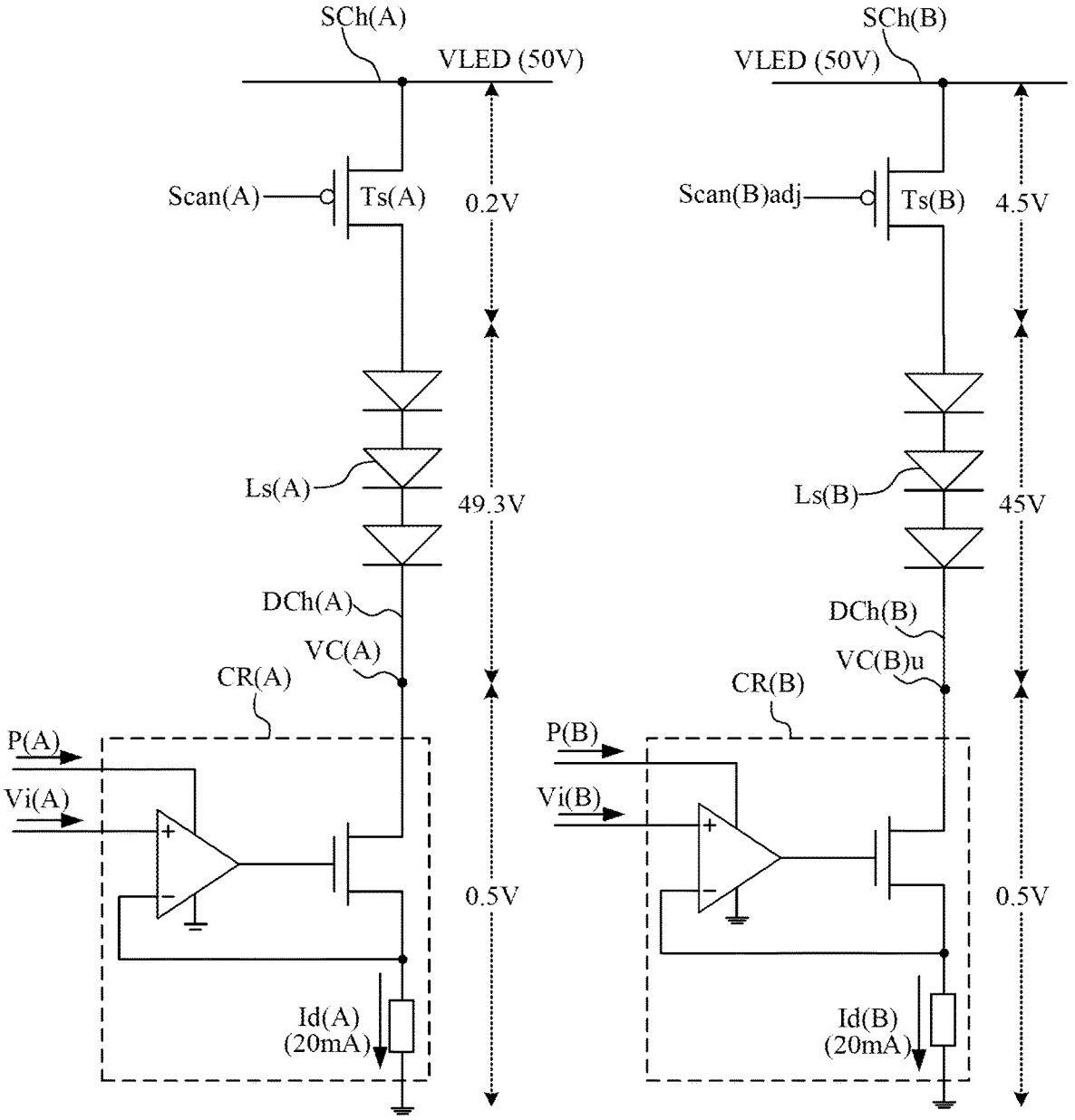
FIG. 12B is a schematic diagram illustrating circuit structures relative to the data channels in FIG. 12A after adjusting a scan voltage signal.

Reference is further made to FIG. 12A and FIG. 12B. FIG. 12A is a schematic diagram illustrating a demonstrational condition that one LED cathode voltage VC(A) reaches the minimal operable voltage Vmin while another LED cathode voltage VC(B) still exceeding the minimal operable voltage Vmin. FIG. 12B is a schematic diagram illustrating circuit structures relative to the data channels DCh(A) and DCh(B) in FIG. 12A after adjusting a scan voltage signal Scan[B]adj.

In some practical applications, due to manufacturing variations, different LED strings may have different electronic parameters. As shown in the demonstrational condition in FIG. 12A, under at the same level of the common driving voltage VLED, a voltage difference over the LED string Ls[A] at 49.3V is different from another voltage difference over the LED string Ls[B] at 45V, because of the manufacturing variations between the LED strings Ls[A] and Ls[B]. As shown in FIG. 12A, the LED cathode voltage VC(A) reaches the minimal operable voltage Vmin while another LED cathode voltage VC(B) still exceeding the minimal operable voltage Vmin (i.e., VC(A)=Vmin and VC(B)>Vmin).

As shown in FIG. 11, FIG. 12A and FIG. 12B, step S340 is executed by the controller 150 to increase a voltage drop (from 0.2V in FIG. 12A to 4.5V in FIG. 12B) over one corresponding scan transistor Ts(B) on the scanning channel SCh(B) by adjusting a scan voltage signal from Scan(B) into Scan(B)adj.

As shown in FIG. 12A and FIG. 12B, in some embodiments, the scan transistor Ts(B) includes a p-channel MOSFET. The voltage drop over the scan transistor Ts(B) is a voltage difference from a source terminal to a drain terminal of the p-channel MOSFET. In FIG. 12A, the voltage drop over the scan transistor Ts(B) is equal to 0.2V. In FIG. 12B, in step S340, the voltage drop over the scan transistor Ts(B) is increased to 4.8V, so as to reduce an updated LED cathode voltage VC(B)u on the scanning channel SCh(B).

As shown in FIG. 12B, by increasing the voltage drop over the scan transistor Ts(B), an updated LED cathode voltage VC(B)u on the scanning channel SCh(B) will be reduced correspondingly (from 4.8V into 0.5V).

Figure 13A:
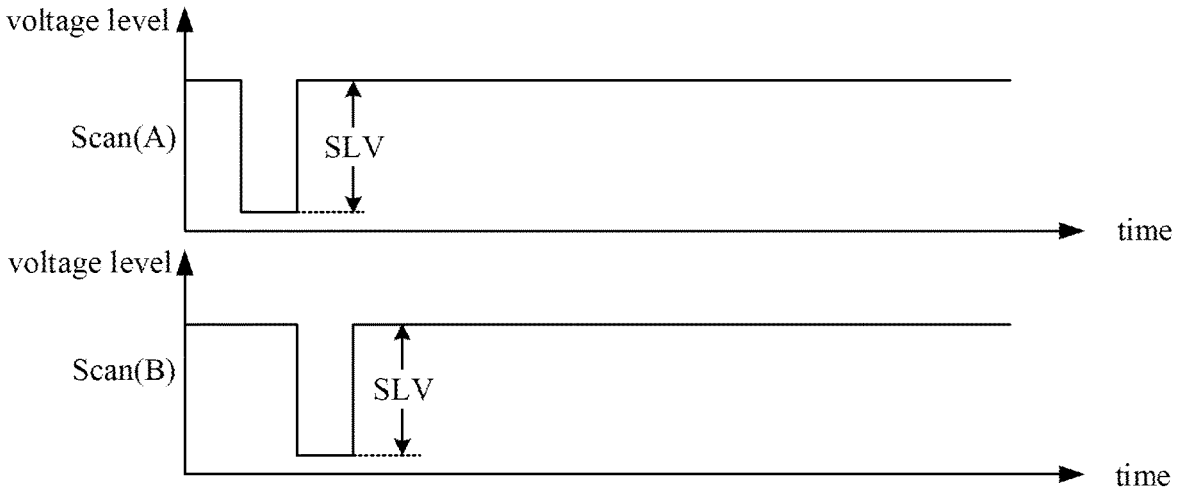
FIG. 13A is a signal diagram illustrating the scan voltage signals for driving the scan transistors before adjustment.
Figure 13B:
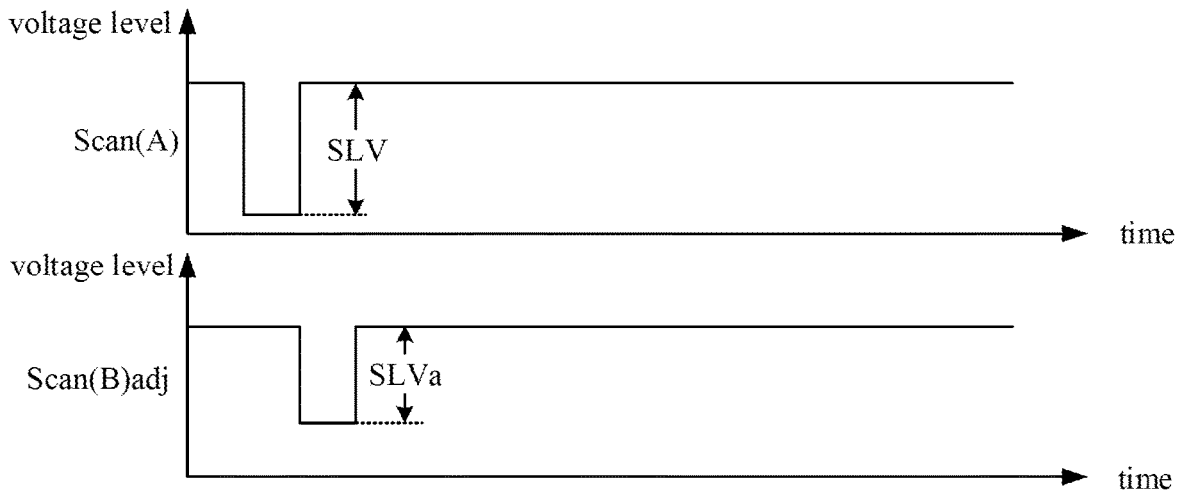
FIG. 13B is a signal diagram illustrating the scan voltage signals for driving the scan transistors.

Reference is further made to FIG. 13A and FIG. 13B. FIG. 13A is a signal diagram illustrating the scan voltage signal Scan(A) for driving the scan transistor Ts(A) and the scan voltage signal Scan(B) for driving the scan transistor Ts(B) before step S340. FIG. 13B is a signal diagram illustrating the scan voltage signal Scan(A) for driving the scan transistor Ts(A) and the scan voltage signal Scan(B) for driving the scan transistor Ts(B) in step S340.

As shown in FIG. 13A, the scan voltage signal Scan(A) for driving the scan transistor Ts(A) and the scan voltage signal Scan(B) for driving the scan transistor Ts(B) share the same voltage level SLV. Because the scan voltage signal Scan(A) and the scan voltage signal Scan(B) shifting downward by the same voltage level SLV while turning on the scan transistors Ts(A) and Ts(B). The voltage drop over the scan transistor Ts(A) and the voltage drop over the scan transistor Ts(B) are similar (in FIG. 13A, both equal to 0.2V).

As shown in FIG. 13B, in step S340, the scan voltage signal Scan(A) is shifted downward by the voltage level SLV, and the scan voltage signal Scan(B)adj is shifted downward by an adjusted voltage level SLVa. As shown in FIG. 13B, |SLVa|<|SLV|. In this case, the scan transistor Ts(B) in FIG. 12B is driven by the signal Scan(B)adj, such that a conductivity of the scan transistor Ts(B) is lower than a conductivity of the scan transistor Ts(A). Accordingly, the voltage drop over the scan transistor Ts(B) can be increased to be larger than the voltage drop over the scan transistor Ts(A).

After step S340, step S341 is executed to detect whether the updated LED cathode voltage VC(B)u still exceeds the minimal operable voltage Vmin. If so, the driving method 300 returns to step S340 to further adjust the scan voltage signal Scan(B)adj.

In addition, as shown in FIG. 11, step S342 is executed to detect whether the updated LED cathode voltage VC(B)u is reduced to be lower than the minimal operable voltage Vmin. Once the updated LED cathode voltage VC(B)u is reduced to be lower than the minimal operable voltage Vmin, step S343 is executed to reset a voltage level of the scan voltage signal Scan(B)adj to a previous voltage level.

When the updated LED cathode voltage VC(B)u is equal to the minimal operable voltage Vmin, step S344 is executed to maintain the voltage level of the scan voltage signal Scan(B)adj.

In this case, the current regulator CR(A) and the current regulator CR(B) can be driven under the same voltage difference. In this case, the heat generated by the current regulator CR(A) can be relatively closer to the heat generated by the current regulator CR(B) in the embodiment shown FIG. 12B after adjusting the scan voltage signal Scan(B)adj, compared to FIG. 12A. In other words, by adjusting the scan voltage signal Scan(B)adj, the driving method 300 is able to improve a heat distribution balance between different current regulators CR1~CRY as shown in FIG. 1. In this case, the heat will not likely to gather at one particular current regulator.

Figure 14:
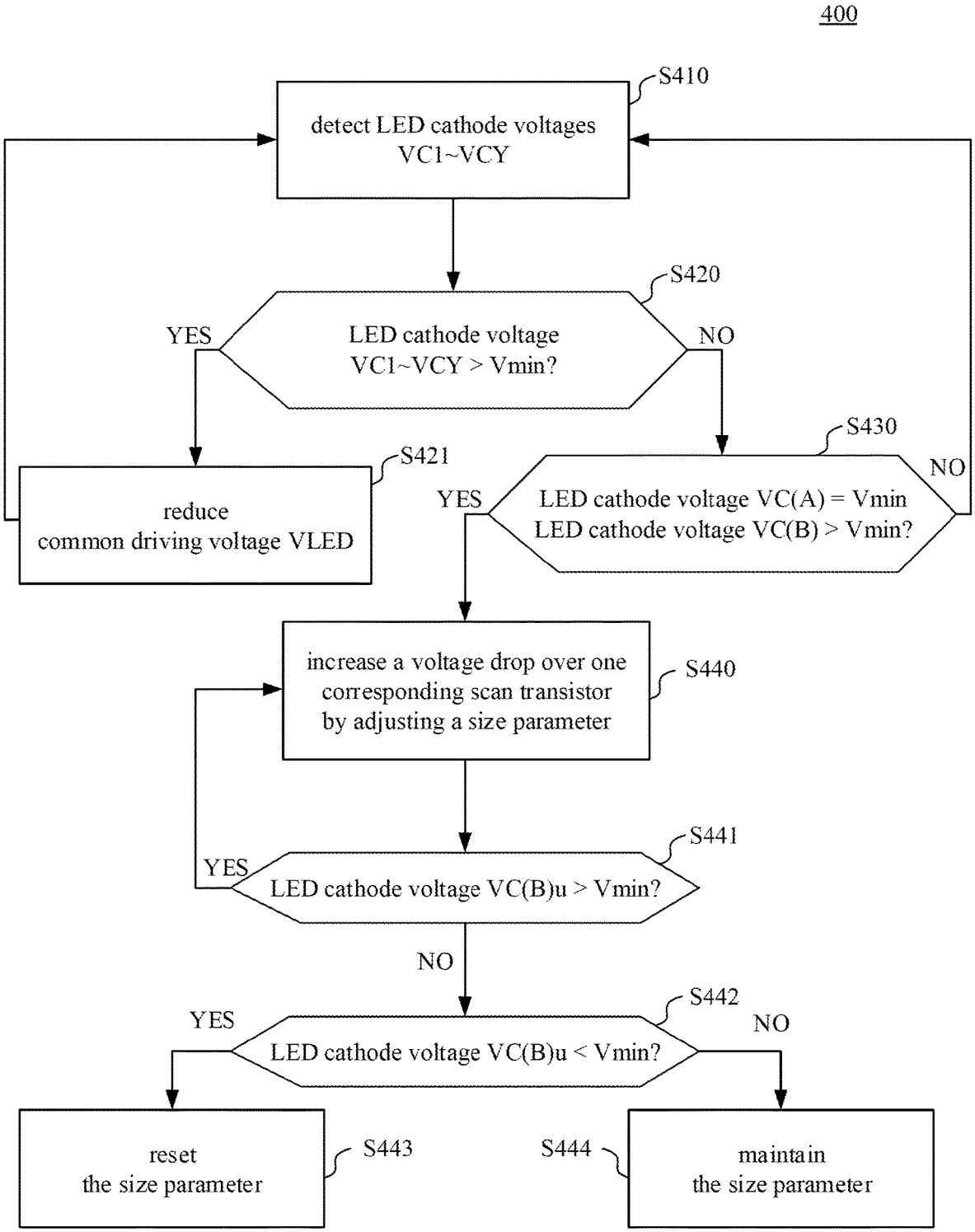
FIG. 14 is a flow chart illustrating a driving method according to some embodiments of the disclosure.

Reference is made to FIG. 14, which is a flow chart illustrating a driving method 400 according to some embodiments of the disclosure. In some embodiments, the driving method 400 in FIG. 14 can be executed by the controller 150 of the display apparatus 100 as shown in FIG. 1.

It is noticed that, steps S440, S443 and S444 in the driving method 400 in FIG. 14 are different from steps S240, S243 and S244 the driving method 200 in FIG. 3 and also different from steps S340, S343 and S344 the driving method 300 in FIG. 11. Other steps S410, S420, S421, S430, S441 and S442 in the driving method 400 in FIG. 14 are similar to steps S210, S220, S221, S230, S241 and S242 in the driving method 200 in FIG. 3 discussed in aforesaid embodiments. Therefore, details of the similar steps are not repeated here again.

Figure 15A:
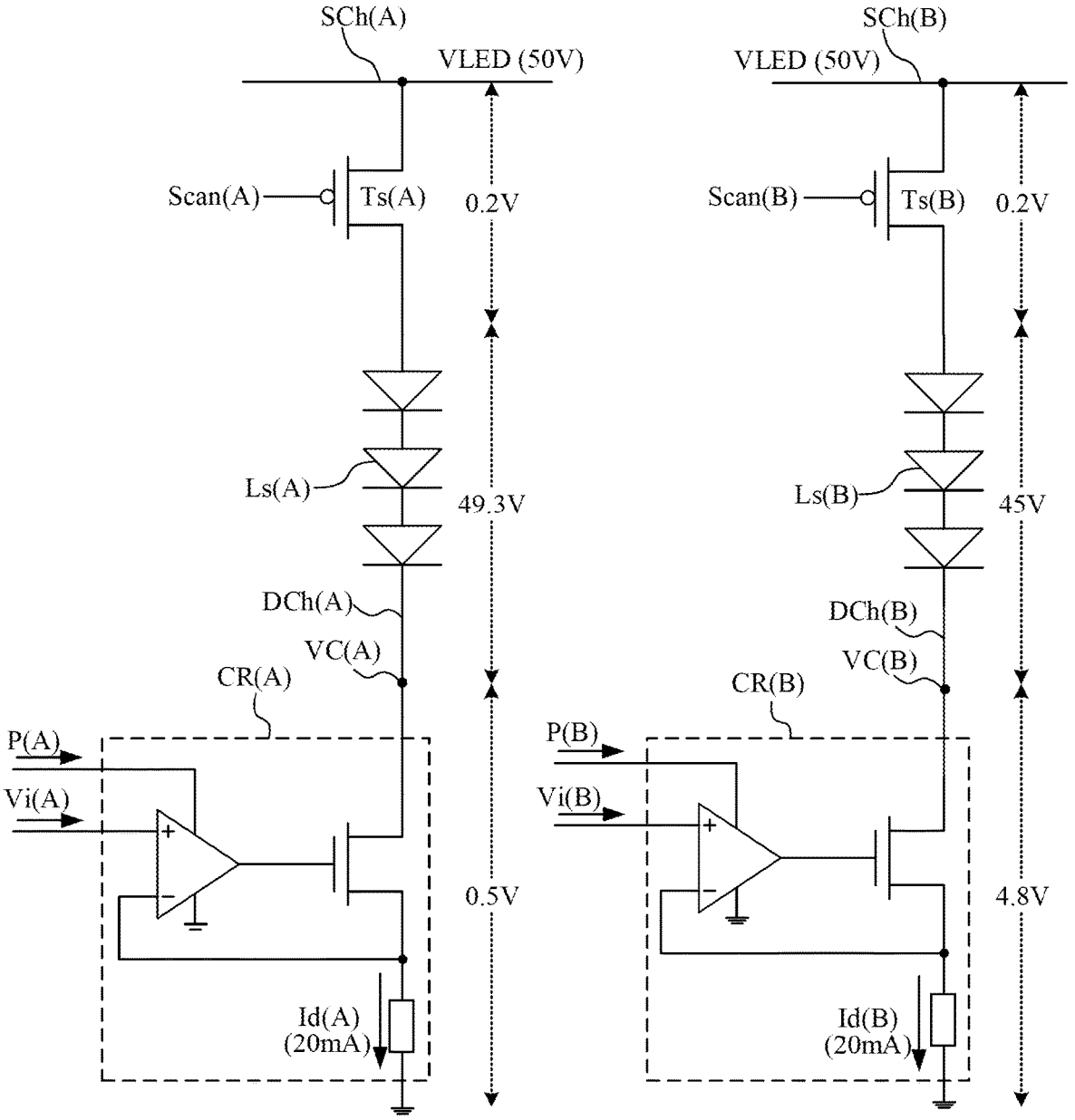
FIG. 15A is a schematic diagram illustrating a demonstrational condition that one LED cathode voltage reaches the minimal operable voltage while another LED cathode voltage still exceeding the minimal operable voltage.
Figure 15B:
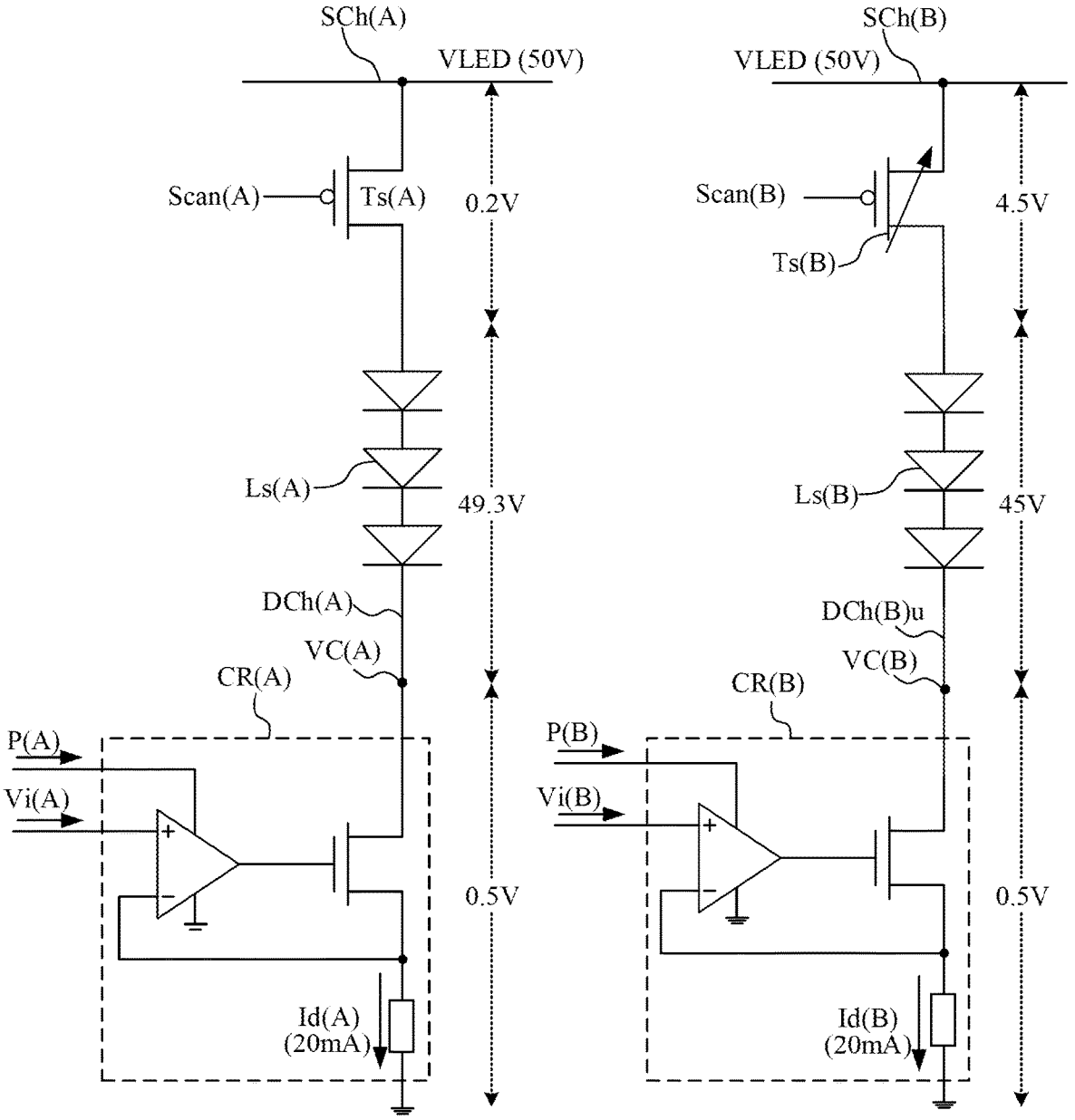
FIG. 15B is a schematic diagram illustrating circuit structures relative to the data channels in FIG. 15A after adjusting a size parameter of the scan transistor.

Reference is further made to FIG. 15A and FIG. 15B. FIG. 15A shows a demonstrational condition that one LED cathode voltage VC(A) reaches the minimal operable voltage Vmin while another LED cathode voltage VC(B) still exceeding the minimal operable voltage Vmin. FIG. 15B is a schematic diagram illustrating circuit structures relative to the data channels DCh(A) and DCh(B) in FIG. 15A after adjusting a size parameter of the scan transistor Ts(B)adj.

In some practical applications, due to manufacturing variations, different LED strings may have different electronic parameters. As shown in the demonstrational condition in FIG. 15A, under at the same level of the common driving voltage VLED, a voltage difference over the LED string Ls[A] at 49.3V is different from another voltage difference over the LED string Ls[B] at 45V, because of the manufacturing variations between the LED strings Ls[A] and Ls[B].

As shown in FIG. 14, FIG. 15A and FIG. 15B, step S440 is executed by the controller 150 to increase a voltage drop (from 0.2V in FIG. 12A to 4.5V in FIG. 12B) over one corresponding scan transistor Ts(B) on the scanning channel SCh(B) by adjusting a size parameter of the scan transistor Ts(B).

In some embodiments, the scan transistor Ts(B) can be adjusted to have a smaller transistor size, a longer channel length or a narrower channel width, so as to increase the voltage drop over the scan transistor Ts(B).

In some embodiments, the scan transistor Ts(B) includes a p-channel MOSFET. The voltage drop over the scan transistor Ts(B) is a voltage difference from a source terminal to a drain terminal of the p-channel MOSFET. In FIG. 15A, the voltage drop over the scan transistor Ts(B) is equal to 0.2V. In FIG. 15B, in step S440, the voltage drop over the scan transistor Ts(B) is increased to 4.8V by adjusting the size parameter of the scan transistor Ts(B). As shown in FIG. 15B, an updated LED cathode voltage VC(B)u on the scanning channel SCh(B) can be reduced correspondingly.

After step S440, step S441 is executed to detect whether the updated LED cathode voltage VC(B)u still exceeds the minimal operable voltage Vmin. If so, the driving method 400 returns to step S440 to further adjust the size parameter of the scan transistor Ts(B).

In addition, as shown in FIG. 14, step S442 is executed to detect whether the updated LED cathode voltage VC(B)u is reduced to be lower than the minimal operable voltage Vmin. Once the updated LED cathode voltage VC(B)u is reduced to be lower than the minimal operable voltage Vmin, step S443 is executed to reset the size parameter of the scan transistor Ts(B) to a previous size parameter.

When the updated LED cathode voltage VC(B)u is equal to the minimal operable voltage Vmin, step S444 is executed to maintain the size parameter of the scan transistor Ts(B).

In this case, the current regulator CR(A) and the current regulator CR(B) can be driven under the same voltage difference. In this case, the heat generated by the current regulator CR(A) can be relatively closer to the heat generated by the current regulator CR(B) in the embodiment shown FIG. 15B after adjusting the size parameter of the scan transistor Ts(B), compared to FIG. 15A.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A driving method, suitable for a controller in a display apparatus, the display apparatus further comprising a plurality of LED strings arranged in X scanning channels and Y data channels, a plurality of scan transistors corresponding to the X scanning channels, a plurality of current regulators corresponding to the Y data channels and a power converter configured to provide a common driving voltage to the X scanning channels, X and Y being positive integers larger than one, the driving method comprising:

detecting a plurality of LED cathode voltages on nodes between the LED strings and the current regulators corresponding to the Y data channels, wherein the LED cathode voltages comprise a first LED cathode voltage corresponding to a first data channel and a second LED cathode voltage corresponding to a second data channel; and in response to the first LED cathode voltage being equal to a minimal operable voltage of the current regulators and the second LED cathode voltage exceeding the minimal operable voltage of the current regulators, adjusting a driving current flowing through the second data channel by increasing a pulse current level of the driving current and reducing a duty cycle ratio of the driving current flowing through the second data channel.

2. The driving method of claim 1, comprising:

in response to the first LED cathode voltage being equal to the minimal operable voltage of the current regulators and the second LED cathode voltage exceeding the minimal operable voltage of the current regulators, providing a pulse width control signal and a level control signal by the controller to one corresponding current regulator on the second data channel for adjusting the driving current.

3. The driving method of claim 1, comprising:

in response to all of the LED cathode voltages exceeding the minimal operable voltage of the current regulators, providing a voltage feedback signal by the controller to the power converter to reduce a voltage level of the common driving voltage.

4. The driving method of claim 1, wherein, after adjusting the driving current, the driving method comprises:

detecting an updated second LED cathode voltage corresponding to the second data channel; and in response to the updated second LED cathode voltage exceeding the minimal operable voltage, keeping increasing the pulse current level of the driving current and reducing the duty cycle ratio of the driving current.

5. The driving method of claim 4, wherein, after adjusting the driving current, the driving method further comprises:

in response to the updated second LED cathode voltage being equal to the minimal operable voltage, maintaining the pulse current level of the driving current and maintaining the duty cycle ratio of the driving current.

6. The driving method of claim 5, wherein, after adjusting the driving current, the driving method further comprises:

in response to the updated second LED cathode voltage being lower than the minimal operable voltage, resetting the pulse current level of the driving current to a previous current level and resetting the duty cycle ratio of the driving current to a previous duty cycle ratio.

7. The driving method of claim 4, wherein an average current level of the driving current during one duty cycle time is constant between the driving current before adjusting and the driving current after adjusting.

8. The driving method of claim 4, wherein each of the current regulators comprises a driving transistor and an operational amplifier, the operational amplifier is configured to control a gate terminal of the driving transistor according to a pulse width control signal and a level control signal provided by the controller.

9. The driving method of claim 8, wherein the driving method further comprises:

utilizing a mapping table to calibrate the level control signal, so as to compensate a non-linearity between a brightness generated by the LED strings and an average current level of the driving current during one duty cycle time.

10. The driving method of claim 9, wherein the mapping table is written into an electric fuse in the controller or a one-time-programmable memory in the controller.

* * * * *